US010770011B2

(12) United States Patent
Lin et al.

(10) Patent No.: US 10,770,011 B2
(45) **Date of Patent: *Sep. 8, 2020**

(54) BUFFER CIRCUIT, PANEL MODULE, AND DISPLAY DRIVING METHOD

(71) Applicant: NOVATEK MICROELECTRONICS CORP., HsinChu (TW)

(72) Inventors: Chieh-An Lin, Taipei (TW); Chun-Yung Cho, Hsinchu County (TW); Jhih-Siou Cheng, New Taipei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 125 days.

This patent is subject to a terminal disclaimer.

(21) Appl. No.: 15/969,763

(22) Filed: May 2, 2018

(65) Prior Publication Data

US 2018/0254012 A1 Sep. 6, 2018

Related U.S. Application Data

(63) Continuation of application No. 14/339,753, filed on Jul. 24, 2014, now Pat. No. 9,997,119.

(30) Foreign Application Priority Data

Feb. 11, 2014 (TW) ..... 103104354 A

(51) Int. Cl.
*G09G 3/36* (2006.01)

(52) U.S. Cl.
CPC ..... *G09G 3/3614* (2013.01); *G09G 3/3685* (2013.01); *G09G 2310/027* (2013.01); *G09G 2310/0291* (2013.01)

(58) Field of Classification Search
CPC ..... G09G 3/3614; G09G 3/3696; G09G 2310/0291
See application file for complete search history.

(56) References Cited

U.S. PATENT DOCUMENTS 5,576,729 A * 11/1996 Yamazaki ..... G09G 3/3614 345/208
8,482,502 B2 * 7/2013 Kim ..... G09G 3/3655 345/92

(Continued)

FOREIGN PATENT DOCUMENTS

CN 102157127 A 8/2011
CN 102157127 A 8/2011

OTHER PUBLICATIONS

Chinese Office Action dated Dec. 2, 2016.
Chinese Office Action dated Sep. 17, 2019.

*Primary Examiner* — Patrick F Marinelli
(74) *Attorney, Agent, or Firm* — Rabin & Berdo, P.C.

(57) ABSTRACT

A buffer circuit, a display module, and a display driving method are disclosed. The buffer circuit comprises a first polarity buffer, a negative polarity buffer. The first polarity buffer receives a first supply voltage and a second supply voltage to output a first reference voltage to a first resistance string. The second supply voltage is less than the first supply voltage. The negative polarity buffer receives the second supply voltage and a third supply voltage to output a negative reference voltage to a negative resistance string. The third supply voltage is less than the second supply voltage.

25 Claims, 10 Drawing Sheets

(56) References Cited

U.S. PATENT DOCUMENTS 8,836,628 B2 * 9/2014 Lee ..... G09G 3/3685 345/96
9,082,365 B2 * 7/2015 Yoon ..... G09G 3/2007
9,106,189 B2 * 8/2015 Lin ..... H03F 3/3022
9,275,600 B2 * 3/2016 Zhu ..... G09G 3/3696
9,343,010 B2 * 5/2016 Yang ..... G09G 3/2011
9,997,119 B2 * 6/2018 Lin ..... G09G 3/3614
2002/0126112 A1 * 9/2002 Kato ..... G09G 3/3685 345/204
2002/0186231 A1 * 12/2002 Kudo ..... G09G 3/20 345/690
2003/0122814 A1 * 7/2003 Yer ..... G09G 3/3696 345/211
2004/0085371 A1 * 5/2004 Lee ..... G09G 3/3655 346/45
2006/0023001 A1 * 2/2006 Sung ..... G09G 3/3688 345/690
2006/0214895 A1 * 9/2006 Shih ..... G09G 3/3607 345/88
2006/0274005 A1 * 12/2006 Miyazaki ..... G09G 3/3688 345/89
2007/0046600 A1 * 3/2007 Sun ..... G09G 3/3688 345/89
2007/0063948 A1 * 3/2007 Nishimura ..... G09G 3/3688 345/89
2007/0216672 A1 * 9/2007 Yang ..... G09G 3/3696 345/211
2008/0049008 A1 * 2/2008 Chen ..... G09G 3/3611 345/211
2008/0055226 A1 * 3/2008 Huang ..... G09G 3/3614 345/100
2008/0094271 A1 * 4/2008 Tooyama ..... H03M 1/0607 341/155
2008/0174289 A1 * 7/2008 Gurcan ..... G05F 1/575 323/280
2009/0040244 A1 * 2/2009 Lee ..... G09G 3/3696 345/690
2009/0085905 A1 * 4/2009 Shang ..... G09G 3/3688 345/212
2009/0135116 A1 * 5/2009 Chang ..... G09G 3/3696 345/87
2009/0201237 A1 * 8/2009 Nishimura ..... H03F 3/45183 345/87
2009/0267882 A1 * 10/2009 Kim ..... G09G 3/3655 345/92
2009/0278868 A1 * 11/2009 Nakahira ..... G09G 3/3696 345/690
2010/0033463 A1 * 2/2010 Nishimura ..... H03F 3/3022 345/211
2010/0100320 A1 * 4/2010 Yu ..... G01S 19/34 701/469
2010/0134462 A1 * 6/2010 Kim ..... G09G 3/3688 345/211
2010/0265273 A1 * 10/2010 Nishimura ..... G09G 3/3688 345/690
2010/0265274 A1 * 10/2010 Han ..... G09G 3/3688 345/690
2011/0063031 A1 * 3/2011 Hsu ..... H03F 3/45237 330/254
2011/0175942 A1 * 7/2011 Ahn ..... G09G 3/3688 345/690
2011/0175943 A1 * 7/2011 Ahn ..... G09G 3/20 345/690
2011/0199360 A1 * 8/2011 Fujiwara ..... G09G 3/3688 345/211
2011/0231654 A1 * 9/2011 Somadder ..... H04L 12/5691 713/153
2012/0098818 A1 * 4/2012 Yoon ..... G09G 3/2007 345/212
2012/0127138 A1 * 5/2012 Tsuchi ..... H03F 1/0261 345/204
2012/0133632 A1 * 5/2012 Hsu ..... H03F 3/4521 345/211
2012/0161661 A1 * 6/2012 Cho ..... G09G 3/3696 315/241 R
2013/0176199 A1 * 7/2013 Lee ..... G09G 3/3655 345/87
2014/0062986 A1 * 3/2014 Huang ..... G09G 3/3696 345/212
2014/0218111 A1 * 8/2014 Lin ..... H03F 3/3022 330/253
2015/0170609 A1 * 6/2015 Jung ..... G09G 3/20 345/212
2015/0187263 A1 * 7/2015 Yang ..... G09G 3/2011 345/212
2015/0228234 A1 * 8/2015 Lin ..... G09G 3/3614 345/212
2016/0098966 A1 * 4/2016 Kim ..... G09G 3/3614 345/690
2016/0117992 A1 * 4/2016 Park ..... G09G 3/3275 345/690
2018/0254012 A1 * 9/2018 Lin ..... G09G 3/3614

* cited by examiner

BUFFER CIRCUIT, PANEL MODULE, AND DISPLAY DRIVING METHOD

This application is a Continuation Application of co-pending U.S. application Ser. No. 14/339,753, filed Jul. 24, 2014, which claims the benefit of Taiwan application Serial No. 103104354, filed Feb. 11, 2014, the subject matter of which is incorporated herein by reference.

BACKGROUND OF THE INVENTION

Field of the Invention

The invention relates in general to an electronic device, and more particularly to a buffer circuit, a display module and a display driving method.

Description of the Related Art

Along with the popularity of display products, liquid crystal display (LCD) products are widely used in people's everyday life. For an LCD to display frames properly, a digital to analog converter (DAC) is used to convert digital signals of image data into analog signals for driving liquid crystal molecules. During the process of converting the digital signals into the analog signals, the DAC employs several levels of gamma reference voltages.

Referring to FIG. 1, a schematic diagram of a positive resistance string, a negative resistance string, a positive polarity buffer and a negative polarity buffer is shown. Since liquid crystal molecules involve polarity conversion, a driver chip normally has a positive resistance string 32 and a negative resistance string 33 respectively representing the voltages at the positive and negative polarities of the driver chip. The positive resistance string 32 and the negative resistance string 33 are also referred as gamma resistors. A positive buffer amplifier 35 provides voltage to the positive resistance string 32. A negative buffer amplifier 36 provides voltage to the negative resistance string 33.

Each position of the positive buffer amplifier 35 on the positive resistance string 32 defines a dividing point, and each position of the negative buffer amplifier 36 on the negative resistance string 33 defines a dividing point. Then, each dividing point enters the DAC, which determines the output voltage and polarity of the driver chip according to the input signals. Since the resistance is inversely proportional to the current consumption, the driver chip will consume hundreds of micro-amperes to a few milliamps on the positive resistance string 32 and the negative resistance string 33, and such amount of current consumption occupies a large proportion of overall current consumption of the driver chip.

SUMMARY OF THE INVENTION

The invention is directed to a buffer circuit, a display module and a display driving method.

According to one embodiment of the present invention, a buffer circuit is disclosed. The buffer circuit comprises a positive polarity buffer, a negative polarity buffer. The positive polarity buffer receives a first supply voltage and a second supply voltage to output a positive reference voltage to a positive resistance string. The second supply voltage is less than the first supply voltage. The negative polarity buffer receives the second supply voltage and a third supply voltage to output a negative reference voltage to a negative resistance string. The third supply voltage is less than the second supply voltage.

According to another embodiment of the present invention, a display module is disclosed. The display module comprises a panel, a positive resistance string, a negative resistance string, a buffer circuit and a driving circuit. The buffer circuit comprises a positive polarity buffer and a negative polarity buffer. The positive polarity buffer receives the first supply voltage and the second supply voltage to output a positive reference voltage to a positive resistance string. The second supply voltage is less than the first supply voltage. The negative polarity buffer receives the second supply voltage and a third supply voltage to output a negative reference voltage to a negative resistance string. The third supply voltage is less than the second supply voltage. The driving circuit drives the panel according to the first reference voltage and the second reference voltage.

According to an alternate embodiment of the present invention, a display driving method is disclosed. The display driving method comprises following steps. A first supply voltage and a second supply voltage are provided to a positive polarity buffer to output a positive reference voltage, wherein the second supply voltage is less than the first supply voltage. The second supply voltage and a third supply voltage are provided to a negative polarity buffer to output a negative reference voltage, wherein the third supply voltage is less than the second supply voltage. A panel is driven according to the positive reference voltage and the negative reference voltage.

The above and other aspects of the invention will become better understood with regard to the following detailed description of the preferred but non-limiting embodiment (s). The following description is made with reference to the accompanying drawings.

DETAILED DESCRIPTION OF THE INVENTION

First Embodiment

Figure 1:
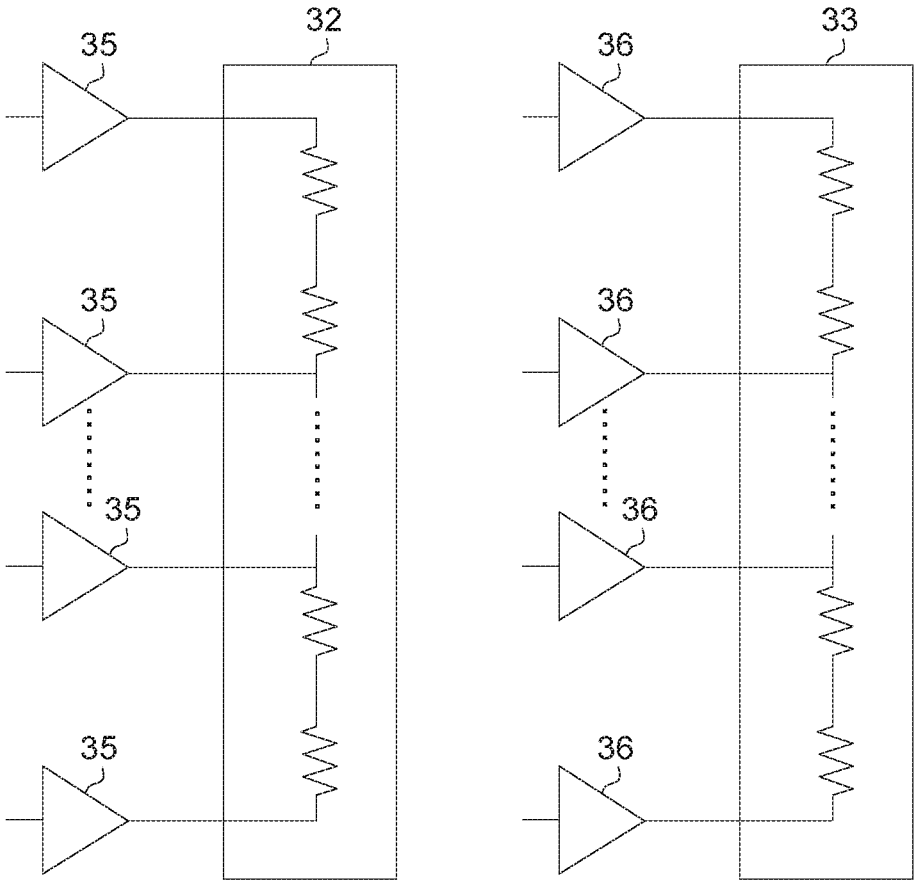
FIG. 1(prior art)
FIG. 1 (prior art) is a schematic diagram of a positive resistance string, a negative resistance string, a positive polarity buffer and a negative polarity buffer.
Figure 2:
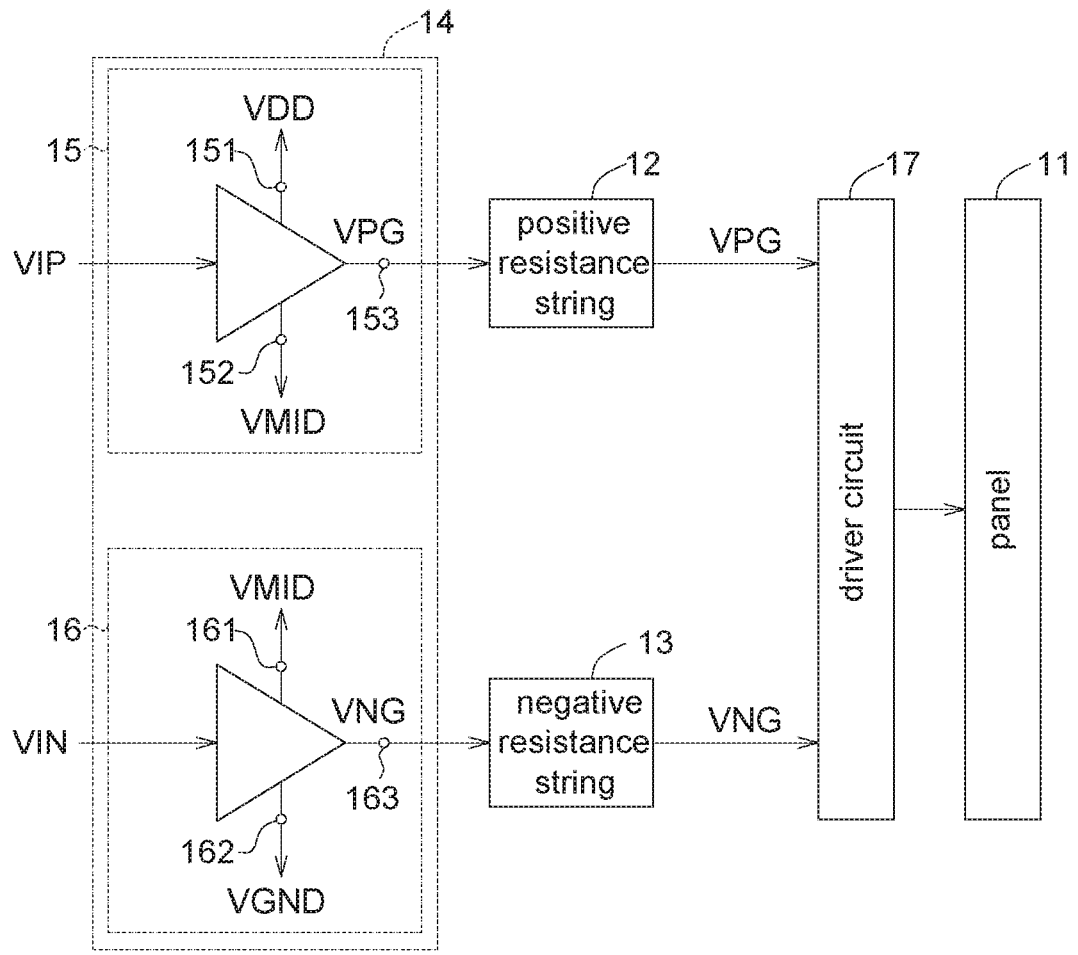
FIG. 2 is a schematic diagram of a display module according to a first embodiment.
Figure 3:
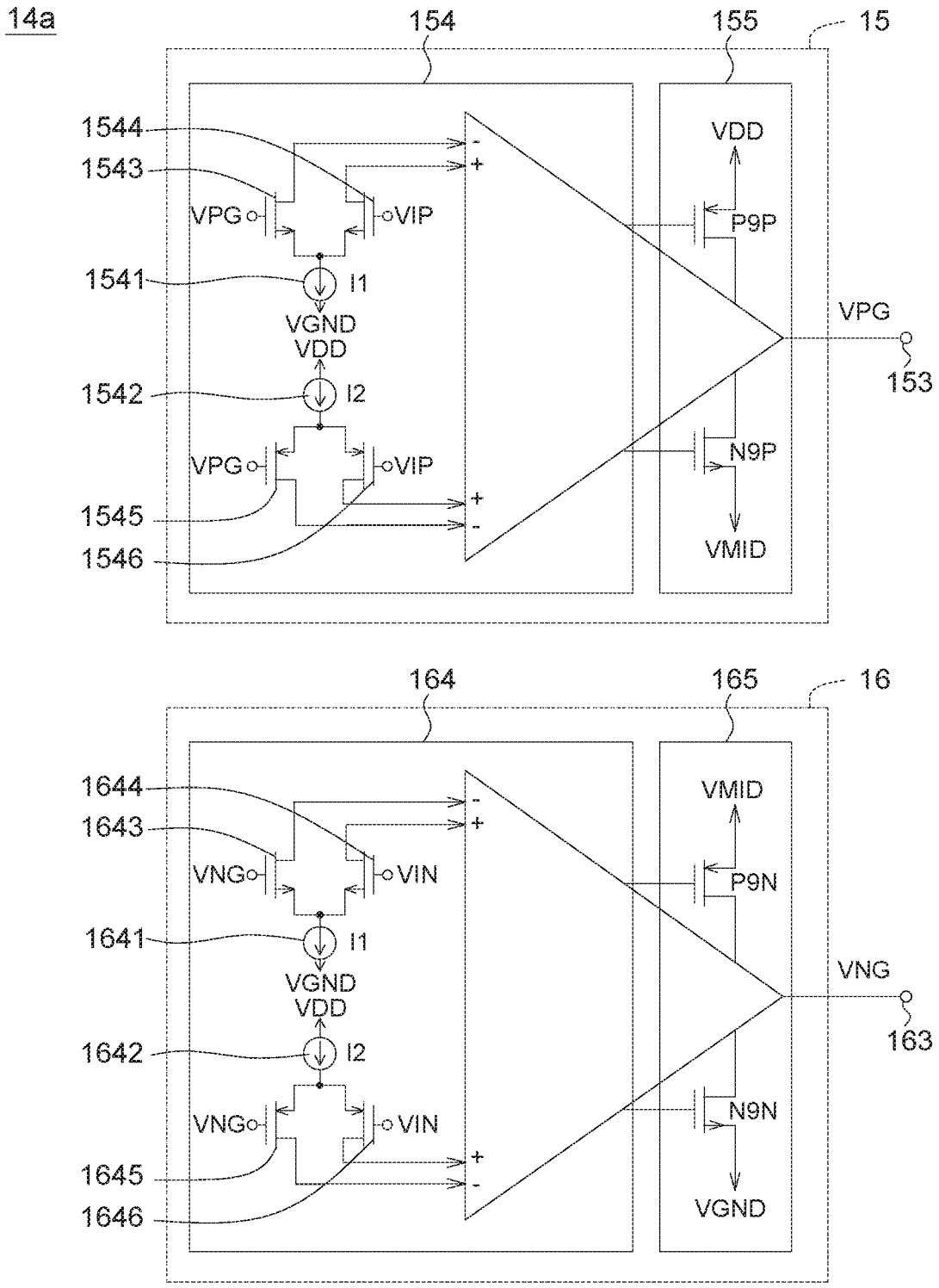
FIG. 3 is a schematic diagram of a buffer circuit according to a first embodiment.

Refer to both FIG. 2 and FIG. 3. FIG. 2 is a schematic diagram of a display module according to a first embodiment. FIG. 3 is a schematic diagram of a buffer circuit according to a first embodiment. The display module 1 comprises a panel 11, a positive resistance string 12, a negative resistance string 13, a buffer circuit 14*a* and a driving circuit 17. The positive resistance string 12 and the negative resistance string 13 can both be realized by such as gamma resistors. The buffer circuit 14*a* comprises a positive polarity buffer 15 and a negative polarity buffer 16. The positive polarity buffer 15 and the negative polarity buffer 16 can both be realized by such as a gamma operational amplifier (Gamma OP). The driving circuit 17 can be realized by such as a source driver chip.

The positive polarity buffer 15 receives a supply voltage VDD and a supply voltage VMID to output a positive reference voltage VPG to a positive resistance string 12 according to an input voltage VIP. The supply voltage VMID is less than the supply voltage VDD. The negative polarity buffer 16 receives the supply voltage VMID and a supply voltage VGND to output a negative reference voltage VNG to a negative resistance string 13 according to an input voltage VIN. The supply voltage VGND is less than the supply voltage VMID, and the supply voltage VGND is substantially equivalent to the ground voltage. That is, the supply voltage VMID is between the supply voltage VDD and the supply voltage VGND. The driving circuit 17 drives the panel 11 according to the positive reference voltage VPG and the negative reference voltage VNG.

Furthermore, the positive polarity buffer 15 comprises a power supply 151, a power supply 152, an output supply 153, a positive input stage 154 and a positive output stage 155. The power supply 151 receives the supply voltage VDD, and the power supply 152 receives the supply voltage VMID. The output supply 153 is coupled to the positive resistance string 12. The positive input stage 154 is coupled to the positive output stage 155. The power supply 151 and the power supply 152 are coupled to the positive output stage 155 to supply the supply voltage VDD and the supply voltage VMID to the positive polarity buffer 15. The negative polarity buffer 16 comprises a power supply 161, a power supply 162, an output supply 163, a negative input stage 164 and a negative output stage 165. The power supply 161 receives the supply voltage VMID, and the power supply 162 receives the supply voltage VGND. The output supply 163 is coupled to the negative resistance string 13. The negative input stage 164 is coupled to the negative output stage 165. The power supply 161 and the power supply 162 are coupled to the negative output stage 165 to supply the supply voltage VMID and the supply voltage VGND to the negative polarity buffer 16.

The positive output stage 155 comprises an output transistor P9P and an output transistor N9P coupled to the output transistor P9P. The power supply 151 is coupled to a source of the output transistor P9P to supply the supply voltage VDD to the positive output stage 155. The power supply 152 is coupled to a source of the output transistor N9P to supply the supply voltage VMID to the positive output stage 155. The negative output stage 165 comprises an output transistor P9N and an output transistor N9N coupled to the output transistor P9N. The power supply 161 is coupled to a source of the output transistor P9N to supply the supply voltage VMID to the negative output stage 165. The power supply 162 is coupled to a source of the output transistor N9N to supply the supply voltage VGND to the negative output stage 165. The currents can be reused when the current at the positive output stage 155 is equivalent to the current at the negative output stage 165.

Figure 4:
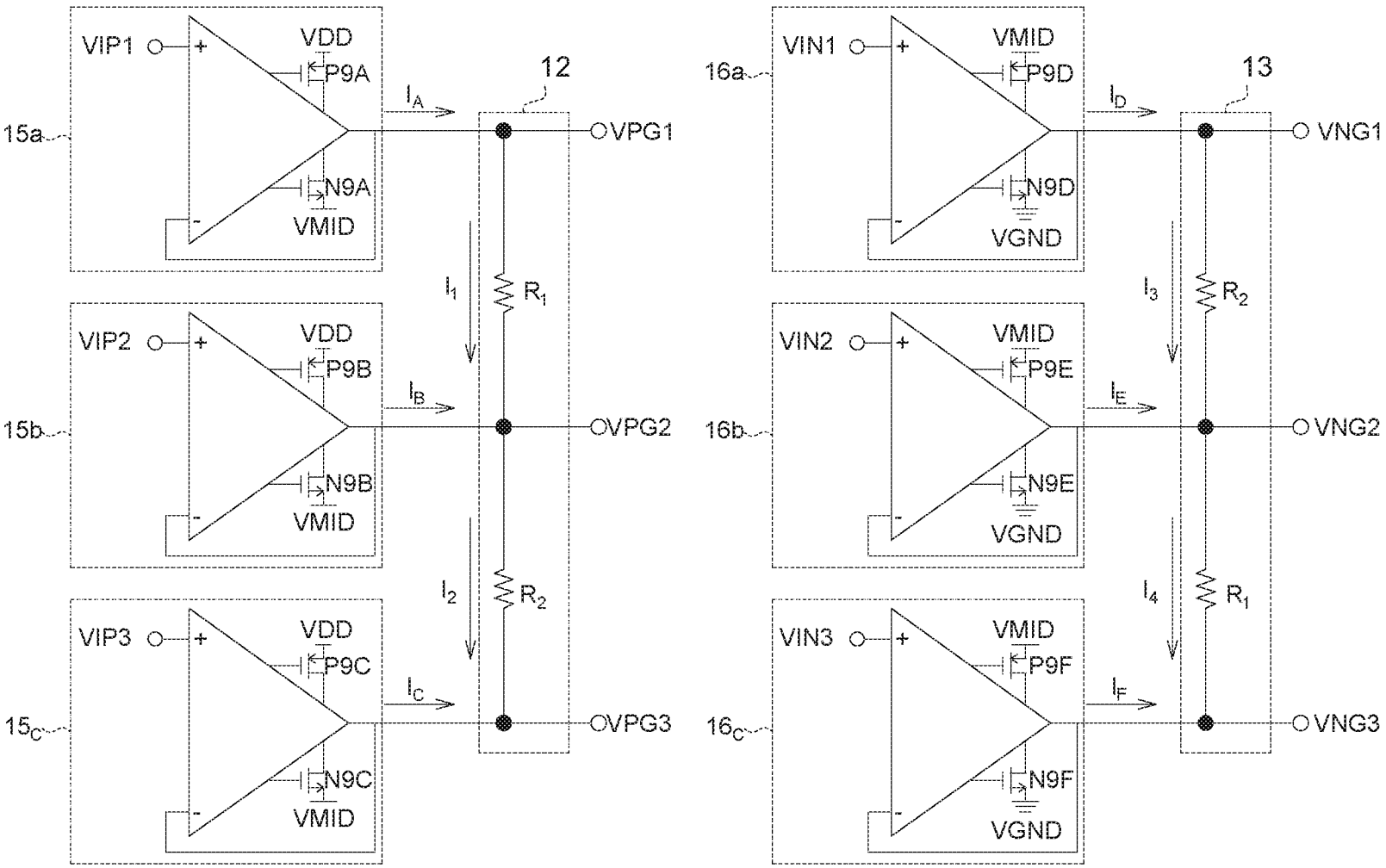
FIG. 4 is a schematic diagram of a positive resistance string coupled to three positive polarity buffers and a negative resistance string coupled to three negative polarity buffers.

Referring to FIG. 4, a schematic diagram of a positive resistance string coupled to three positive polarity buffers and a negative resistance string coupled to three negative polarity buffers is shown. Positive polarity buffers 15*a*, 15*b* and 15*c* output positive reference voltages VPG1, VPG2 and VPG3 to the positive resistance string 12 according to input voltages VIP1, VIP2 and VIP3 respectively. Negative polarity buffers 16*a*, 16*b* and 16*c* output negative reference voltages VNG1, VNG2 and VNG3 to the negative resistance string 13 according to input voltages VIN1, VIN2 and VIN3 respectively.

The positive polarity buffer 15*a* comprises an output transistor P9A and an output transistor N9A. The positive polarity buffer 15*b* comprises an output transistor P9B and an output transistor N9B. The positive polarity buffer 15*c* comprises an output transistor P9C and an output transistor N9C. The negative polarity buffer 16*a* comprises an output transistor P9D and an output transistor N9D. The negative polarity buffer 16*b* comprises an output transistor P9E and an output transistor N9E. The negative polarity buffer 16*c* comprises an output transistor P9F and an output transistor N9F.

The positive resistance string 12 comprises a resistance divider $R_1$ and a resistance divider $R_2$ coupled to the resistance divider $R_1$. The negative resistance string 13 comprises a resistance divider $R_1$ and a resistance divider $R_2$ coupled to the resistance divider $R_1$. The positive polarity buffers 15*a*, 15*b*, and 15*c* and the negative polarity buffers 16*a*, 16*b* and 16*c* output currents $I_A$, $I_B$, $I_C$, $I_D$, $I_E$ and $I_F$ respectively. The currents $I_1$ and $I_2$ flow through the resistance dividers $R_1$ and $R_2$ of the positive resistance string 12 respectively. The currents $I_3$ and $I_4$ flow through the resistance dividers $R_2$ and $R_1$ of the negative resistance string 13 respectively.

The positive resistance string 12 takes the current $I_A$ from the supply voltage VDD. Then, the current $I_A$ flows to the positive resistance string 12 via the output transistor P9A, and further flows to the supply voltage VMID via the output transistor N9C. The negative resistance string 13 takes the current $I_D$ via the supply voltage VMID. Then, the current $I_D$ flows to the negative resistance string 13 via the output transistor P9D, and further flows to the supply voltage VGND via the output transistor N9F. If the resistance at the positive resistance string 12 is equivalent to the resistance at the negative resistance string 13 and the voltage difference between two ends of the positive resistance string 12 is equivalent to the voltage difference between two ends of the negative resistance string 13, then the voltage and current of the positive resistance string 12 are symmetric to the voltage and current of the negative resistance string 13. In comparison to the design of operating the positive polarity buffers 15*a*, 15*b*, and 15*c* and the negative polarity buffers 16*a*, 16*b* and 16*c* by using the supply voltages VDD and VGND, the design of the present embodiment can reduce current consumption to a half. If the positive resistance string 12 and the negative resistance string 13 are asymmetric or have different bias points, then current deficiency will be compensated by the supply voltage VMID or current surplus will overflow from the supply voltage VMID. Regardless whether the resistance at the positive resistance string 12 is equivalent to the resistance of the negative resistance string 13 or the voltage difference between two ends of the positive resistance string 12 is equivalent to the voltage difference between two ends of the negative resistance string 13, the above embodiments can achieve the object of lower current consumption.

Second Embodiment

Figure 5:
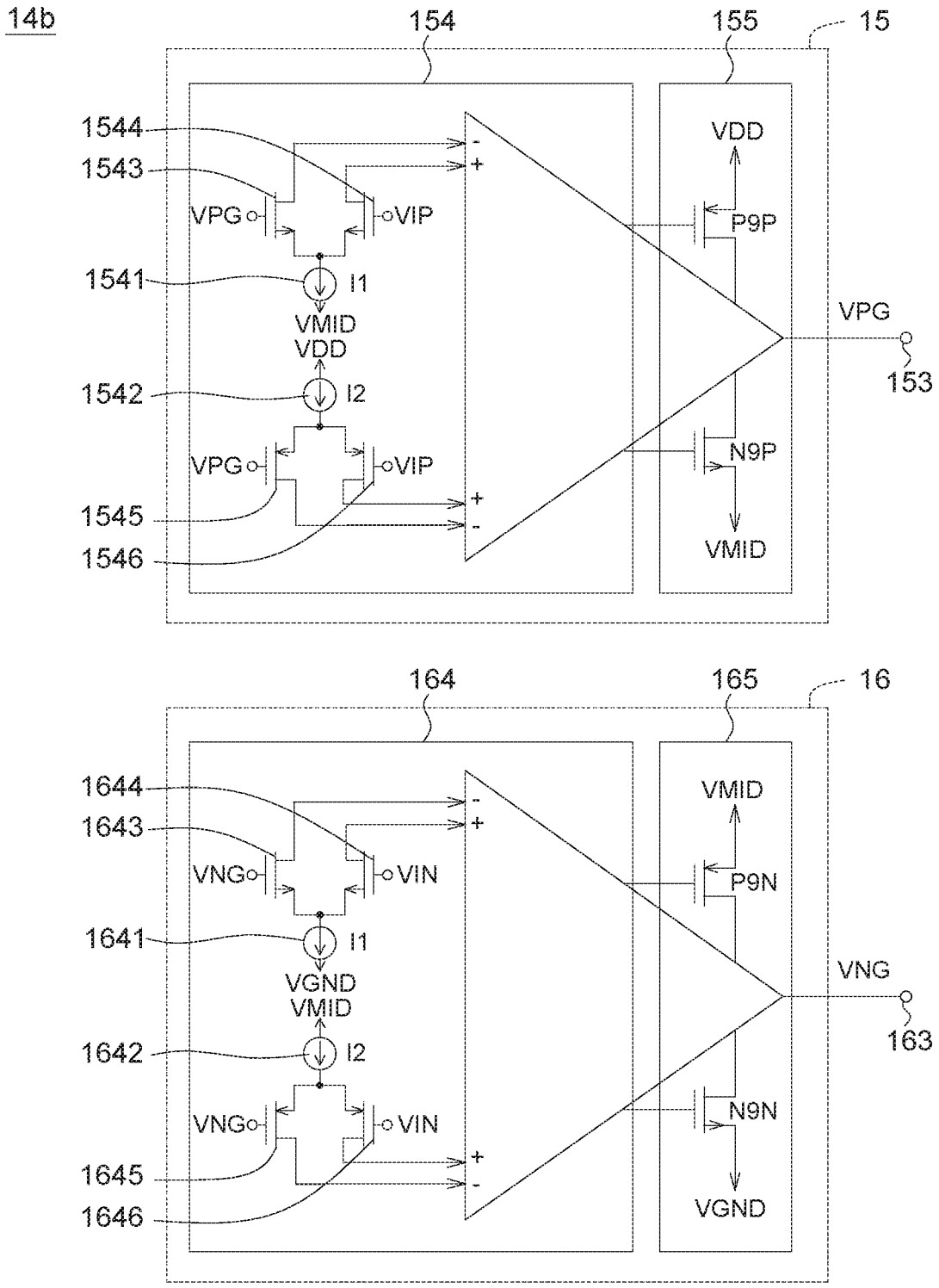
FIG. 5 is a schematic diagram of a buffer circuit according to a second embodiment.

Refer to both FIG. 2 and FIG. 5. FIG. 5 is a schematic diagram of a buffer circuit according to a second embodiment. The second embodiment is different from the first embodiment mainly in that the power supply 151 and the power supply 152 are coupled to the positive input stage 154 of a buffer circuit 14*b* to supply the supply voltage VDD and the supply voltage VMID to the positive polarity buffer 15. The power supply 161 and the power supply 162 are coupled to the negative input stage 164 of a buffer circuit 14*b* to supply the supply voltage VMID and the supply voltage VGND to the negative polarity buffer 16.

The positive input stage 154 comprises current sources 1541, 1542, and 1543 and input resistors 1544, 1545 and 1546. The input resistors 1543 and 1544 are coupled to the current source 1541. The input resistors 1545 and 1546 are coupled to the current source 1542. The power supply 152 is coupled to the current source 1541 to supply the supply voltage VMID to the positive input stage 154. The power supply 151 is coupled to the current source 1542 to supply the supply voltage VDD to the positive input stage 154.

The negative input stage 164 comprises current sources 1641, 1642, and 1643 and input resistors 1644, 1645 and 1646. The input resistors 1643 and 1644 are coupled to the current source 1641. The input resistors 1645 and 1646 are coupled to the current source 1642. The power supply 162 is coupled to the current source 1641 to supply the supply voltage VGND to the negative input stage 164. The power supply 161 is coupled to the current source 1642 to supply the supply voltage VMID to the negative input stage 164.

Third Embodiment

Figure 6:
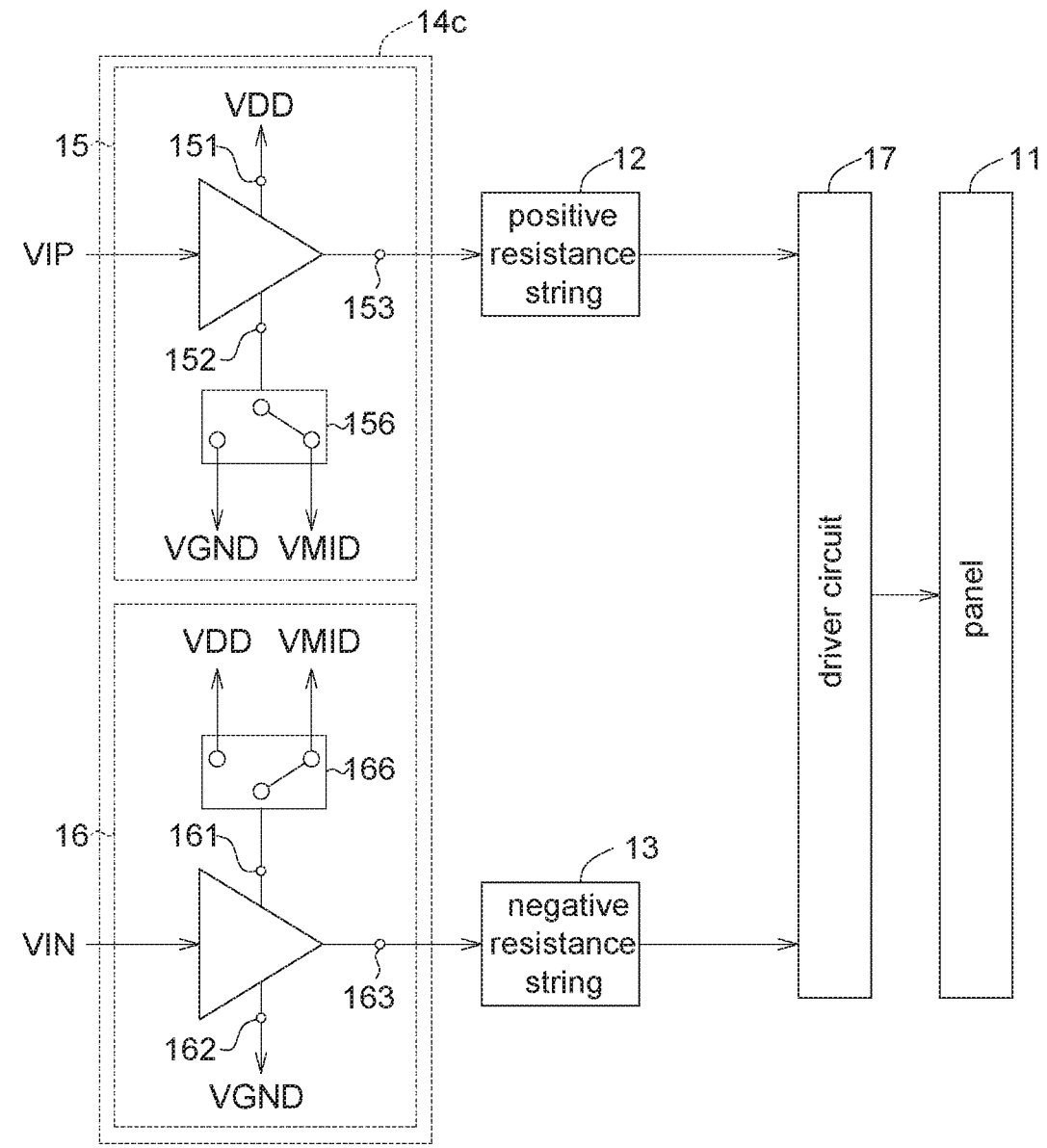
FIG. 6 is a schematic diagram of a display module according to a third embodiment.

Referring to FIG. 6, a schematic diagram of a display module according to a third embodiment is shown. The third embodiment is different from the first embodiment mainly in that buffer circuit 14*c* of the display module 3 further comprises selection switches 156 and 166. The selection switch 156 outputs the supply voltage VMID or the supply voltage VGND to the positive polarity buffer 15. The selection switch 166 outputs the supply voltage VMID or the supply voltage VDD to the negative polarity buffer 16. When the selection switch 156 outputs the supply voltage VMID to the positive polarity buffer 15 and the selection switch 166 outputs the supply voltage VMID to the negative polarity buffer 16, the object of lower current consumption can be achieved.

Fourth Embodiment

Figure 7:
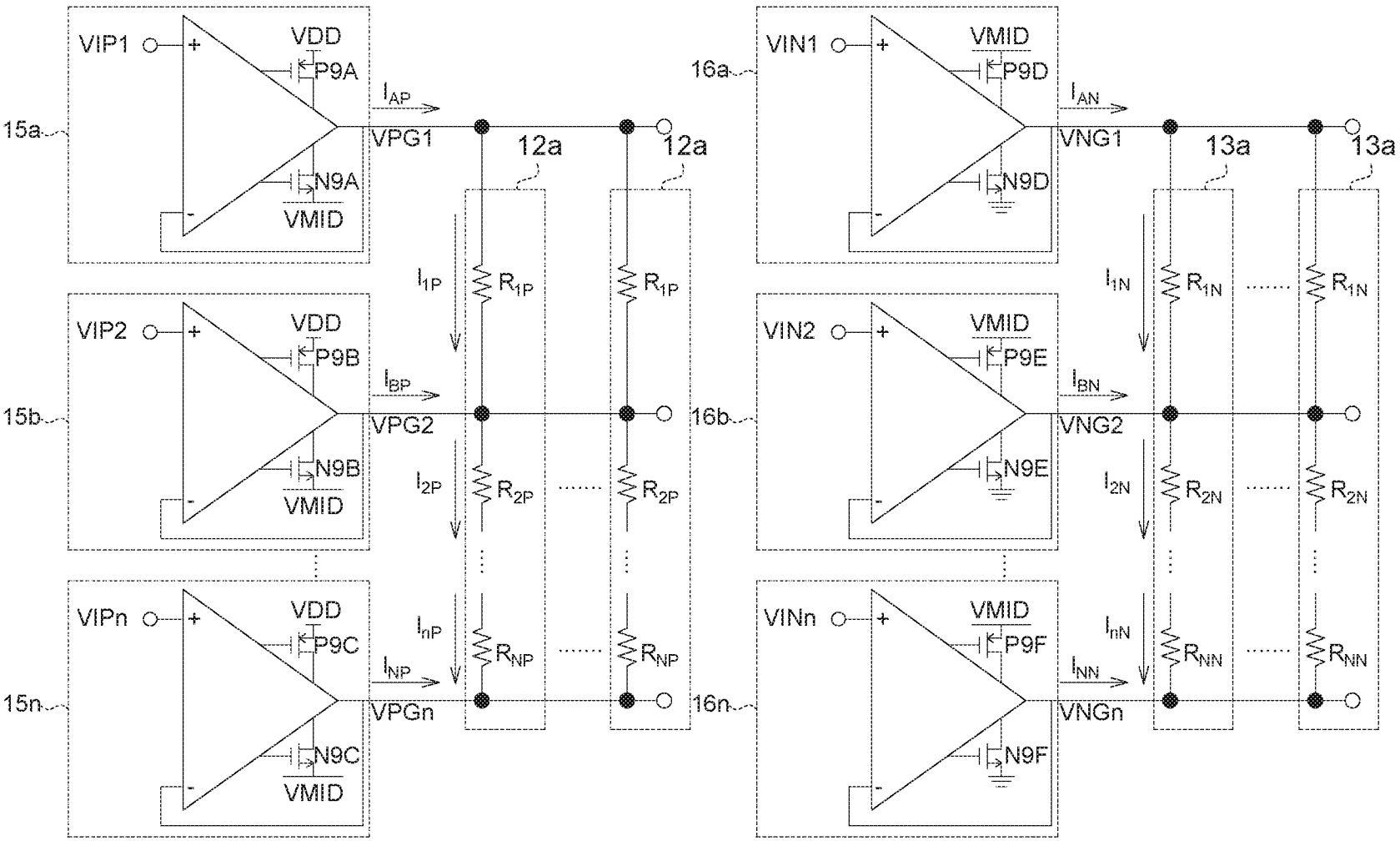
FIG. 7 is a schematic diagram of m positive resistance strings coupled to n positive polarity buffers and m negative resistance strings coupled to n negative polarity buffers according to a fourth embodiment.

Referring to FIG. 7, a schematic diagram of m positive resistance strings coupled to n positive polarity buffers and m negative resistance strings coupled to n negative polarity buffers according to a fourth embodiment is shown. The positive polarity buffers 15*a*~15*n* output positive reference voltages VPG1~VPGn to m positive resistance strings 12*a* according to input voltages VIP1~VIPn respectively, wherein n and m both are a positive integer greater than 1. The m positive resistance strings 12*a* comprises resistance dividers $R_{1P}$~$R_{NP}$, wherein the m positive resistance strings 12*a* are disposed in parallel. The negative polarity buffers 16*a*~16*n* output the negative reference voltages VNG1~VNGn to m negative resistance strings 13*a* according to the input voltages VIN1~VINn respectively. The negative resistance strings 13*a* comprise resistance dividers $R_{1N}$~$R_{NN}$, wherein the m negative resistance strings 13*a* are disposed in parallel. The positive polarity buffers 15*a*~15*n* and the negative polarity buffers 16*a*~16*n* output currents $I_{AP}$~$I_{NP}$ and currents $I_{AN}$~$I_{NN}$ respectively. The currents $I_{IP}$~$I_{nP}$ flow through the resistance dividers $R_{1P}$~$R_{NP}$ respectively. The currents $I_{1N}$~$I_{nN}$ flow through the resistance dividers $R_{1N}$~$R_{NN}$ respectively.

Fifth Embodiment

Figure 8:
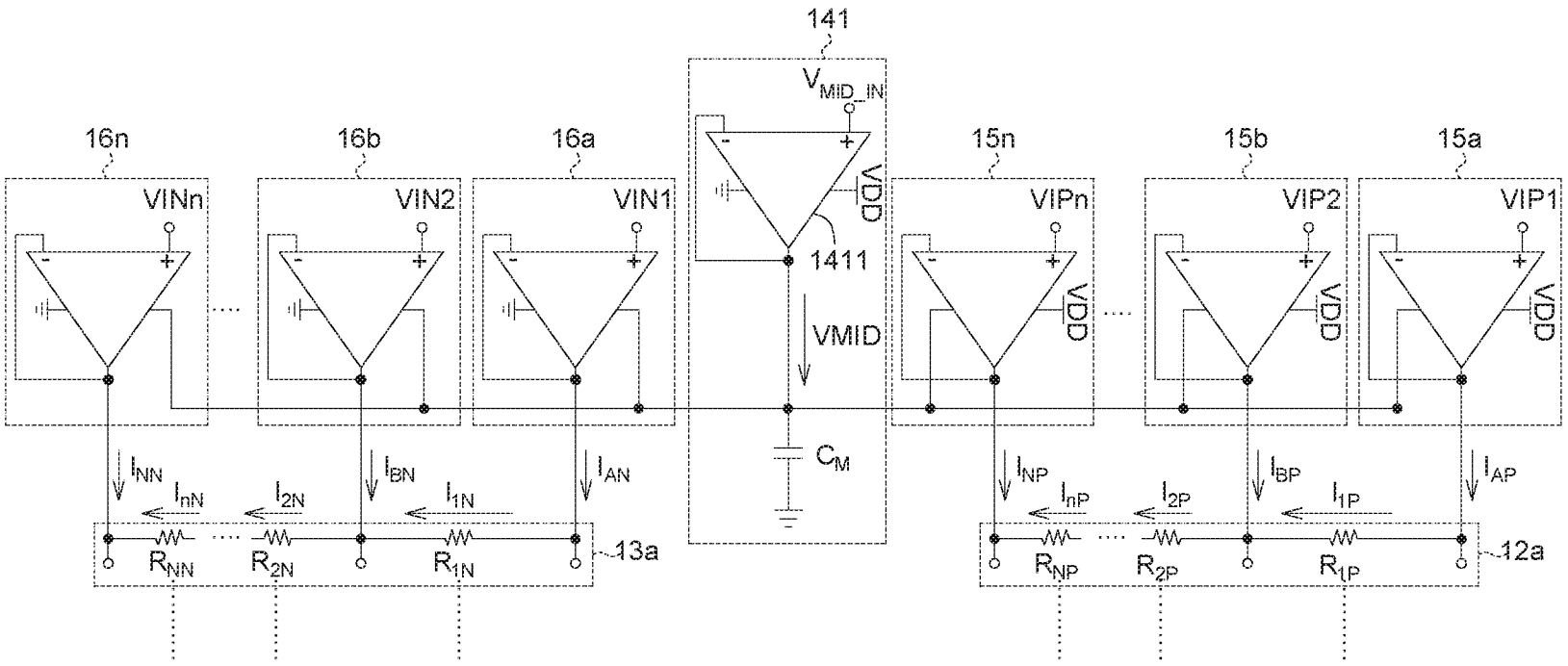
FIG. 8 is a schematic diagram of supply voltage VMID provided by supply voltage output circuit according to a fifth embodiment.

Referring to FIG. 7 and FIG. 8. FIG. 8 is a schematic diagram of supply voltage VMID provided by supply voltage output circuit according to a fifth embodiment. The fifth embodiment is different from the fourth embodiment mainly in that the buffer circuit of the fifth embodiment further comprises a supply voltage output circuit 141. The supply voltage output circuit 141 comprises a medium voltage buffer 1411 and a capacitor $C_M$. However, the implementation of the supply voltage output circuit 141 is not limited to above exemplification. In some embodiments, the supply voltage output circuit 141 can also be realized by a low drop out (LDO) linear voltage regulator or a back converter.

Sixth Embodiment

Figure 9:
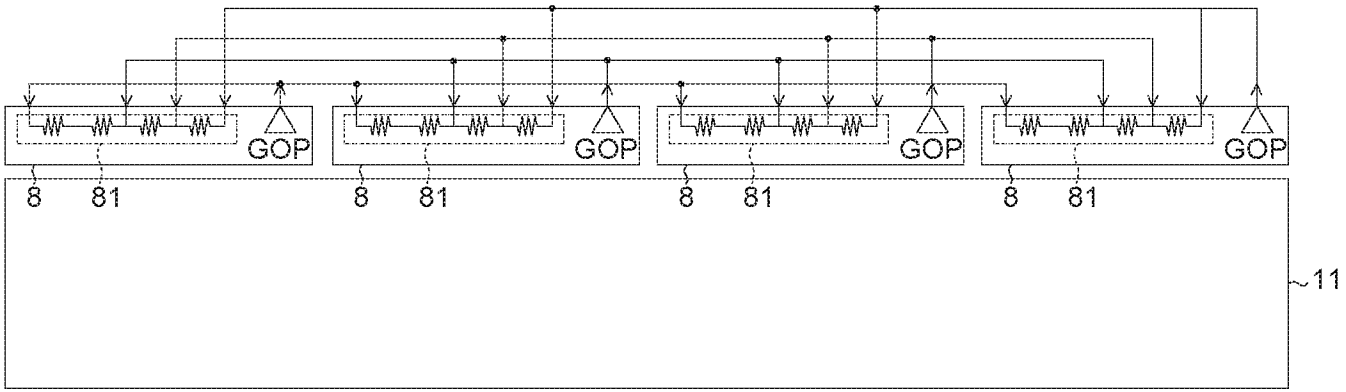
FIG. 9 is a schematic diagram of a display module according to a sixth embodiment.

Refer to FIG. 2 and FIG. 9. FIG. 9 is a schematic diagram of a display module according to a sixth embodiment. The aforementioned positive and negative resistance strings are in-built in the source driver chip 8 like the resistance string 81 of FIG. 9, and the aforementioned positive and negative polarity buffers are in-built in the source driver chip 8 like the buffer GOP of FIG. 9.

Seventh Embodiment

Figure 10:
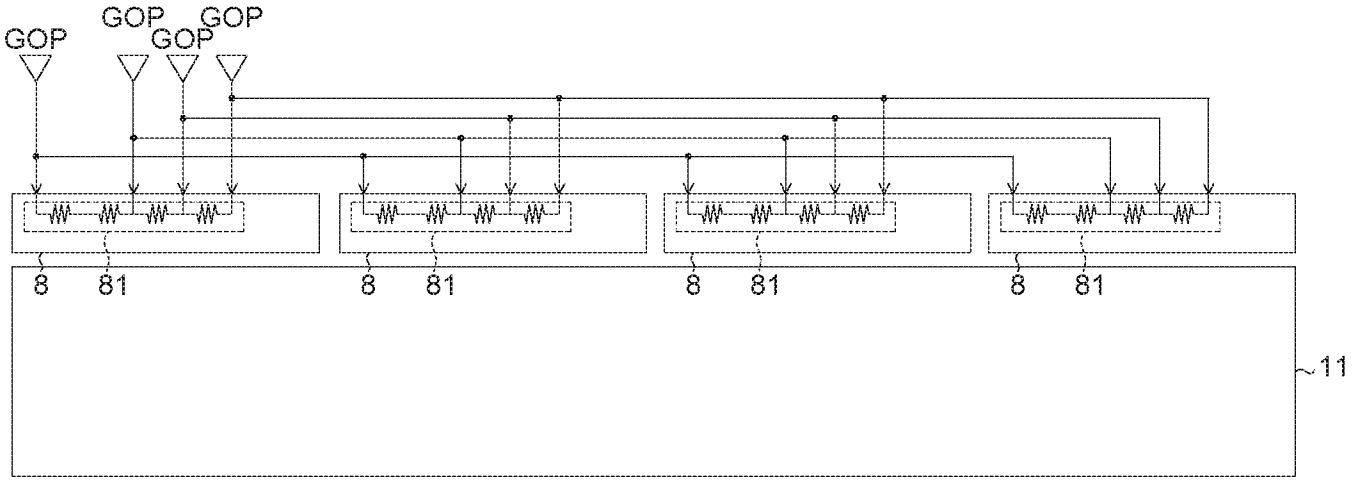
FIG. 10 is a schematic diagram of a display module according to a seventh embodiment.

Refer to FIG. 2 and FIG. 10. FIG. 10 is a schematic diagram of a display module according to a seventh embodiment. The aforementioned positive and negative resistance strings are in-built in the source driver chip 8 like the resistance string 81 of FIG. 9, and the aforementioned positive and negative polarity buffers are not in-built in the source driver chip 8 like the buffer GOP of FIG. 10. In other words, the aforementioned positive and negative polarity buffers are disposed outside the source driver chip 8 like the buffer GOP of FIG. 10.

Eighth Embodiment

Figure 11:
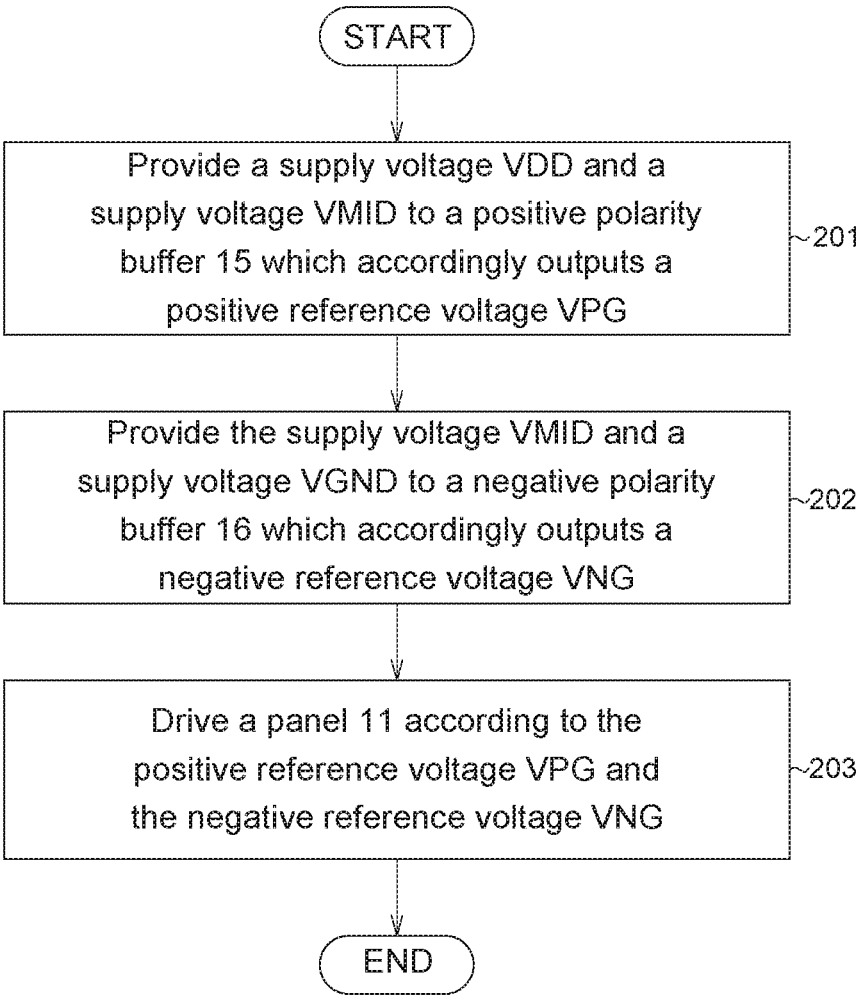
FIG. 11 is a flowchart of a display driving method according to an eighth embodiment.

Referring to FIG. 2 and FIG. 11. FIG. 11 is a flowchart of a display driving method according to an eighth embodiment. The display driving method comprises following steps. Firstly, the method begins at step 201, a supply voltage VDD and a supply voltage VMID are supplied to a positive polarity buffer 15 which accordingly outputs a positive reference voltage VPG. Next, the method proceeds to step 202, the supply voltage VMID and a supply voltage VGND are provided to a negative polarity buffer 16 which accordingly outputs a negative reference voltage VNG. Then, the method proceeds to step 203, a panel 11 is driven according to the positive reference voltage VPG and the negative reference voltage VNG.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gamma circuit, comprising:

a first polarity gamma buffer having a first power receiving terminal for receiving a first supply voltage, and having a second power receiving terminal for receiving a second supply voltage which is different from a ground voltage, to output a first reference voltage to a plurality of first resistance strings;

a supply voltage output circuit for providing the second supply voltage; and a second polarity gamma buffer having a third power receiving terminal for receiving the second supply voltage and having a fourth power receiving terminal for receiving a third supply voltage lower than the second supply voltage, to output a second reference voltage to a plurality of second resistance strings, wherein the supply voltage output circuit comprises a medium voltage gamma buffer having an output terminal and a capacitor coupled to the output terminal of the medium voltage gamma buffer, the medium voltage gamma buffer comprises a first power supply for receiving the first supply voltage, a second power supply for receiving the third supply voltage and an output supply that outputs the second supply voltage, and each of the second power receiving terminal and the third power receiving terminal is coupled to the output terminal of the medium voltage gamma buffer, and wherein the output terminal of the medium gamma buffer is connected to an inverting input terminal of the medium voltage gamma buffer.

2. The gamma circuit according to claim 1, wherein the first polarity gamma buffer comprises:

a first power supply for receiving the first supply voltage;

a second power supply for receiving the second supply voltage; and a first output supply coupled to one of the first resistance strings.

3. The gamma circuit according to claim 2, wherein the second polarity gamma buffer comprises:

a third power supply for receiving the second supply voltage;

a fourth power supply for receiving the third supply voltage; and a second output supply coupled to one of the second resistance strings.

4. The gamma circuit according to claim 3, wherein the first polarity gamma buffer further comprises a first input stage and a first output stage; the first input stage is coupled to the first output stage; the first power supply and the second power supply are coupled to the first output stage; the second polarity gamma buffer comprises a second input stage and a second output stage; the second input stage is coupled to the second output stage; the third power supply and the fourth power supply are coupled to the second output stage.

5. The gamma circuit according to claim 4, wherein the first output stage comprises a first output transistor and a second output transistor; the second output transistor is coupled to the first output transistor; the first power supply is coupled to a source of the first output transistor; the second power supply is coupled to a source of the second output transistor; the second output stage comprises a third output transistor and a fourth output transistor; the fourth output transistor is coupled to the third output transistor; the third power supply is coupled to a source of the third output transistor; the fourth power supply is coupled to a source of the fourth output transistor.

6. The gamma circuit according to claim 3, wherein the first polarity gamma buffer further comprises a first input stage and a first output stage; the first input stage is coupled to the first output stage; the first power supply and the second power supply are coupled to the first input stage; the second polarity gamma buffer comprises a second input stage and a second output stage; the second input stage is coupled to the second output stage; the third power supply and the fourth power supply are coupled to the second input stage.

7. The gamma circuit according to claim 6, wherein the first input stage comprises a first current source, a second current source, a first input resistor, a second input resistor, a third input resistor and a fourth input resistor; the first input resistor and the second input resistor are coupled to a first current source; the third input resistor and the fourth input resistor are coupled to a second current source; the second power supply is coupled to the first current source; the first power supply is coupled to the second current source; the second input stage comprises a third current source, a fourth current source, a fifth input resistor, a sixth input resistor, a seventh input resistor and an eighth input resistor; the fifth input resistor and the sixth input resistor are coupled to a third current source; the seventh input resistor and the eighth input resistor are coupled to a fourth current source; the fourth power supply is coupled to the third current source; the third power supply is coupled to the fourth current source.

8. The buffer circuit according to claim 1, wherein the first resistance strings, the second resistance strings, the first polarity gamma buffer and the second polarity gamma buffer are in-built in a source driver chip.

9. The gamma circuit according to claim 1, wherein the first resistance strings and the second resistance strings are in-built in a source driver chip; the first polarity gamma buffer and the second polarity gamma buffer are not in-built in the source driver chip.

10. The gamma circuit according to claim 1, wherein the supply voltage output circuit is a low drop out (LDO) linear voltage regulator.

11. The gamma circuit according to claim 1, wherein the supply voltage output circuit is a back converter.

12. The gamma circuit according to claim 1, wherein resistance values of each of the first resistance strings are equivalent to resistance values of each of the second resistance strings.

13. The gamma circuit according to claim 1, wherein the first resistance string has different bias points from the second resistance string.

14. The gamma circuit according to claim 1, wherein a current deficiency is compensated by one of the first and second supply voltages.

15. The gamma circuit according to claim 1, wherein the first resistance strings are disposed in parallel and the second resistance strings are disposed in parallel, the first resistance strings comprise a plurality of resistance dividers, each of the resistance dividers has a first terminal and a second terminal, the first terminals of $i^{th}$ resistance dividers are connected with each other, the second terminals of $i^{th}$ resistance dividers are connected with each other, the second resistance strings comprise a plurality of resistance dividers, each of the resistance dividers has a first terminal and a second terminal, the first terminals of jth resistance dividers are connected with each other, the second terminals of jth resistance dividers are connected with each other.

16. The gamma circuit according to claim 1, wherein the medium voltage gamma buffer outputs the second supply voltage to an inversion terminal of the medium voltage buffer.

17. The gamma circuit according to claim 1, wherein resistance values of each of the first resistance strings are asymmetric to resistance values of each of the second resistance strings.

18. The gamma circuit according to claim 1, wherein the plurality of first resistance strings only receive the first reference voltage, and the plurality of second resistance strings only receive the second reference voltage.

19. A buffer circuit, comprising:

a first polarity gamma buffer having a first power receiving terminal for receiving a first supply voltage and having a second power receiving terminal for receiving a second supply voltage, to output a first reference voltage to at least one first resistance string;

a supply voltage output circuit; and a second polarity gamma buffer having a third power receiving terminal for receiving the second supply voltage and having a fourth power receiving terminal for receiving a third supply voltage, to output a second reference voltage to a second resistance string, wherein the third supply voltage is less than the second supply voltage;

wherein the supply voltage output circuit comprises a medium voltage gamma buffer having an output terminal and a capacitor coupled to the output terminal of the medium voltage gamma buffer, and the medium voltage gamma buffer comprises a first power supply for receiving the first supply voltage, a second power supply for receiving the third supply voltage and an output supply that outputs the second supply voltage, and each of the second power receiving terminal and the third power receiving terminal is coupled to the output terminal of the medium voltage gamma buffer, wherein the supply voltage output circuit provides the second supply voltage which is different from a ground voltage, and wherein the output terminal of the medium gamma buffer is connected to an inverting input terminal of the medium voltage gamma buffer.

20. The buffer circuit according to claim 19, wherein the second supply voltage is less than the first supply voltage, the first supply voltage is larger than the ground voltage, the second supply voltage is larger than the ground voltage, and the third supply voltage is equal to the ground voltage.

21. The buffer circuit according to claim 19, wherein the first polarity gamma buffer comprises:

a first power supply for receiving the first supply voltage;

a second power supply for receiving the second supply voltage; and a first output supply coupled to the first resistance string.

22. The buffer circuit according to claim 19, wherein the second polarity gamma buffer comprises:

a third power supply for receiving the second supply voltage;

a fourth power supply for receiving the third supply voltage; and a second output supply coupled to the second resistance string.

23. The buffer circuit according to claim 19, wherein the at least one first resistance string only receives the first reference voltage, and at least one second resistance string only receives the second reference voltage.

24. A driving device, comprising:

a first resistance string;

a second resistance string;

a first polarity gamma buffer having a first power receiving terminal for receiving a first supply voltage and having a second power receiving terminal for receiving a second supply voltage, to output a first reference voltage to the first resistance string, wherein the second supply voltage is different from a ground voltage;

a supply voltage output circuit for providing the second supply voltage;

a second polarity gamma buffer having a third power receiving terminal for receiving the second supply voltage and having a fourth power receiving terminal for receiving a third supply voltage, to output a second reference voltage to the second resistance string, wherein the third supply voltage is less than the second supply voltage; and a driving circuit for driving a panel according to the first reference voltage and the second reference voltage;

wherein the supply voltage output circuit comprises a medium voltage gamma buffer having an output terminal and a capacitor coupled to the output terminal of the medium voltage gamma buffer, and the medium voltage gamma buffer comprises a first power supply for receiving the first supply voltage, a second power supply for receiving the third supply voltage and an output supply that outputs the second supply voltage, and each of the second power receiving terminal and the third power receiving terminal is coupled to the terminal of the medium voltage gamma buffer, and wherein the output terminal of the medium gamma buffer is connected to an inverting input terminal of the medium voltage gamma buffer.

25. The driving device according to claim 24, wherein the first resistance string only receives the first reference voltage, and the second resistance string only receives the second reference voltage.

* * * * *